United States Patent [19]

Diab et al.

[11] Patent Number: 5,049,040

[45] Date of Patent: Sep. 17, 1991

[54] COMPRESSOR CAPACITY MODULATION

[75] Inventors: Tariq A. R. Diab, Anna; Jerry L. Miller, Dayton; Earl B. Muir, Sidney, all of Ohio

[73] Assignee: Copeland Corporation, Sidney, Ohio

[21] Appl. No.: 420,822

[22] Filed: Oct. 12, 1989

[51] Int. Cl.[5] ..... F04B 49/00

[52] U.S. Cl. ..... 417/274; 417/275

[58] Field of Search ..... 417/274, 275, 276, 277

[56] References Cited

U.S. PATENT DOCUMENTS

| | | | |
|---|---|---|---|
| 2,261,911 | 11/1941 | Condit | 417/275 |
| 3,964,518 | 6/1976 | Hesse et al. | 137/628.64 |
| 4,211,256 | 7/1980 | Sturtz | 137/625.64 |
| 4,368,755 | 1/1983 | King . | |
| 4,548,234 | 10/1985 | Prenger . | |
| 4,685,489 | 8/1987 | Yun et al. | 417/274 X |

*Primary Examiner*—Gerald A. Michalsky

*Attorney, Agent, or Firm*—Harness, Dickey & Pierce

[57] ABSTRACT

A variable capacity compressor in which each compression chamber has a reexpansion chamber the volume of which is selectively controlled by pressurized lubricant.

18 Claims, 6 Drawing Sheets

COMPRESSOR CAPACITY MODULATION

BACKGROUND AND SUMMARY OF THE INVENTION

The present invention relates to compressors, and more particularly to variable capacity compressors using a reexpansion type modulating system.

One of the primary objects of the present invention resides in the provision of a capacity modulating system which is infinitely variable between zero modulation and maximum modulation. This is accomplished by utilizing existing lubricating fluid under pressure in combination with a unique arrangement of valves to infinitely control the position of a modulating piston in a reexpansion chamber, thereby establishing the volume of the reexpansion chamber and the degree of modulation. The invention is quite simple and relatively inexpensive in construction, is suited for use with single cylinder or multiple cylinder compressors, is relatively quiet in operation, is more efficient than reexpansion type capacity modulators which operate at only two positions (i.e., maximum or minimum and nothing in between), provides positive control of the modulating piston thereby eliminating the need for return springs, and incorporates means whereby the performance dynamics of the system may be easily changed.

Other advantages and features of this invention will become apparent from the following specification taken in connection with the accompanying drawings.

DESCRIPTION OF THE PREFERRED EMBODIMENT

The capacity modulation system of the present invention is of the reexpansion volume type, and is applicable to many different types of compression devices, i.e. any compression device in which increasing reexpansion volume in the compression chamber decreases pumping capacity. For exemplary purposes the present invention is illustrated herein incorporated in a accessible hermetic refrigerant compressor of the type belonging to the "Copelametic" family of compressors manufactured by the assignee of this invention. Only the portions of the compressor which are applicable to the present design will be discussed, all other structural details and functions of the compressor being well-known in the art.

Figure 1:
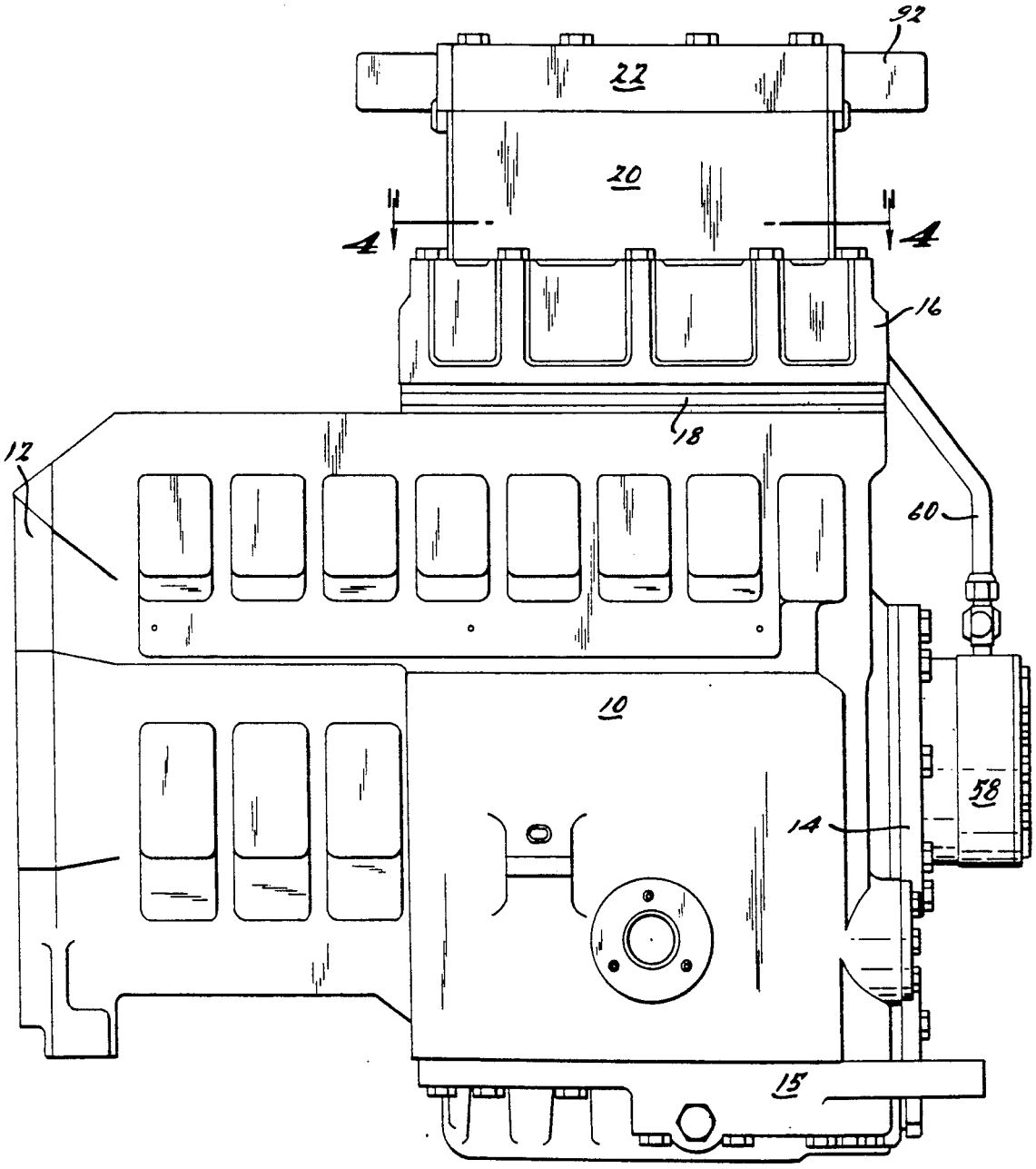
FIG. 1 is a side elevational view of an accessible hermetic refrigerant compressor embodying the principles of the present invention.
Figure 2:
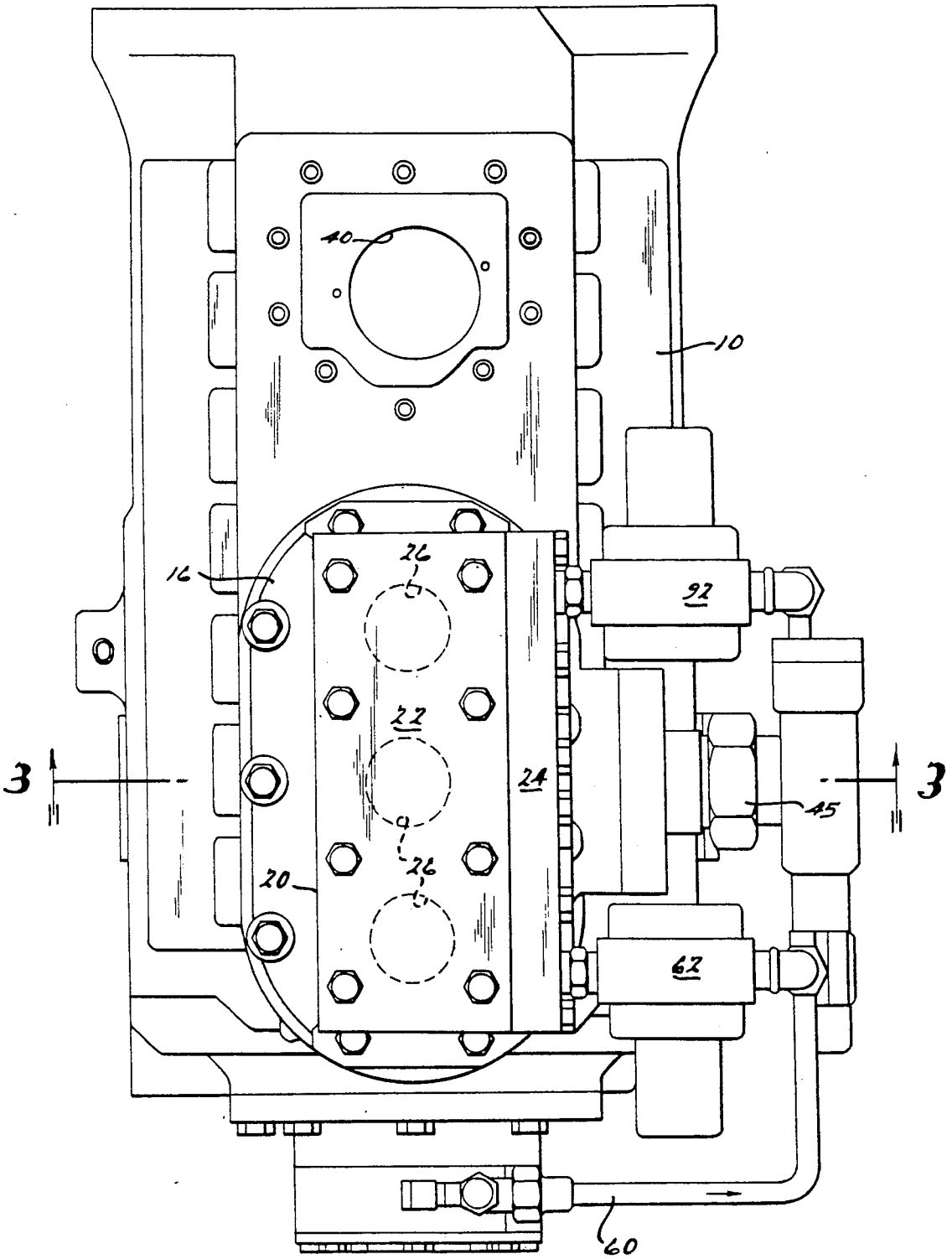
FIG. 2 is a top plan view of the compressor shown in FIG. 1.
Figure 3:
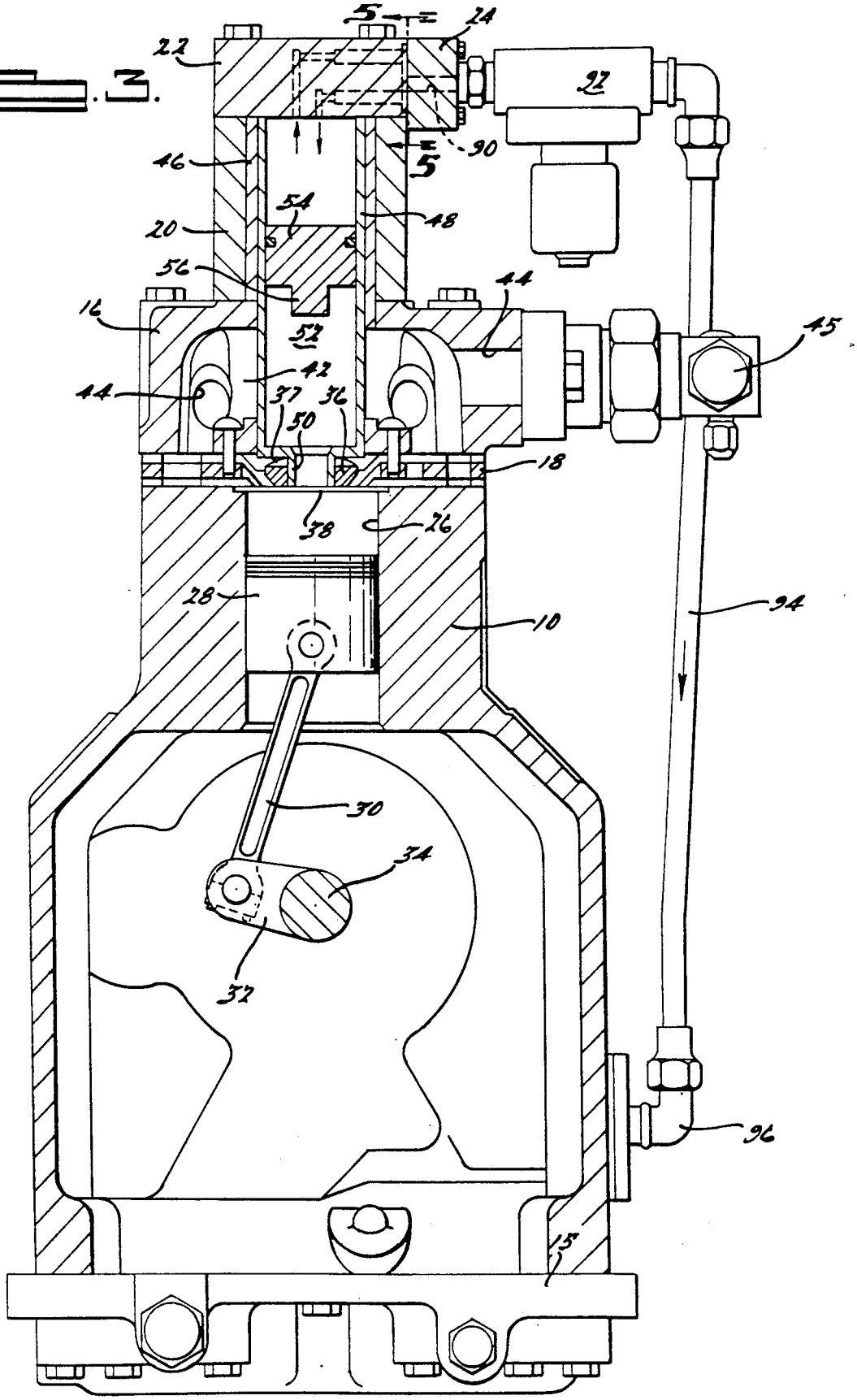
FIG. 3 is a partial vertical sectional view taken generally along line 3—3 in FIG. 2.
Figure 4:
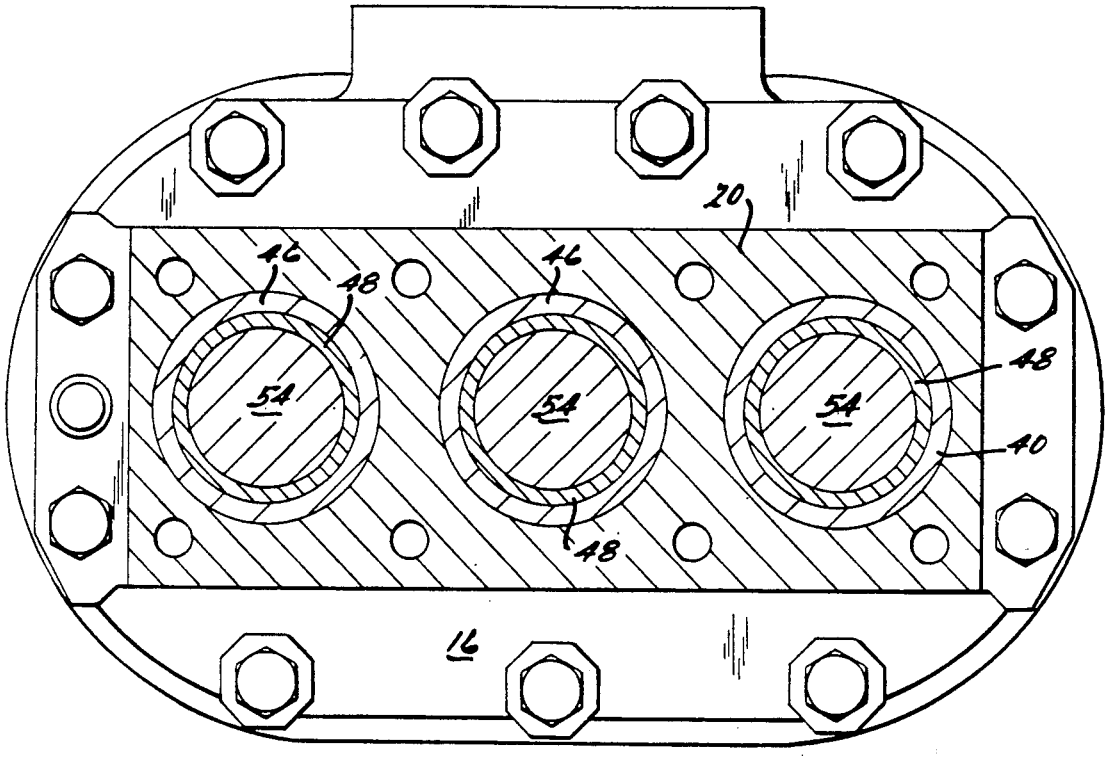
FIG. 4 is a horizontal sectional view taken generally along line 4—4 in FIG. 1.

With particular reference to FIGS. 1-3, the overall machine comprises generally a compressor body 10 which is hermetically sealed at its rearward end by a closure 12 defining a motor chamber therein, at its forward end by a closure 14 defining a compressor chamber therein and at the bottom thereof by a closure 15 defining a sump therein for lubricating oil. A cylinder head 16 is bolted to the top of body 10 with a valve assembly 18 clamped therebetween, a capacity modulation assembly including a housing 20 and a head 22 is bolted to cylinder head 16, and a modulator manifold 24 is affixed to head 22.

Compressor body 10 defines a plurality of compression chambers or cylinders 26 which at the top thereof are in fluid communication with valve assembly 18, and in each of which is reciprocatingly disposed a compressing member in the form of a piston 28 connected by the usual wrist pin to a connecting rod 30 driven by a crank 32 on a crankshaft 34 powered by a motor (not shown) in the aforesaid motor chamber of compressor body 10. Valve assembly 18 is of the type shown in U.S. Pat. Nos. 4,368,755 and 4,548,234, the disclosures of which are incorporated herein by reference, and includes a "Discus" type discharge valve 36 biased to a normally closed position by an annular spring 37, and a conventional ring suction valve 38. Suction gas is introduced into the compressor via the usual fitting (not shown) at port 40 and through the motor chamber to passages in the cylinder head (not shown) to valve assembly 18 and suction valve 38 into the compression chamber 26. Compressed discharge gas is discharged in the usual manner through discharge valve 36 to the usual common discharge chamber 42, passage 44 and discharge fitting 45.

Modulation housing 20 has for each compression chamber 26 a spacer sleeve 46 in which is disposed a modulation cylinder 48 which has an open top sealingly engaging head 22 and a partially closed bottom from which extends a tubular portion 50 which ends substantially flush with the lower surface of valve assembly 18. Discharge valve 36 sealingly engages and rides on the outside of tubular portion 36. Cylinder 48 defines a reexpansion chamber 52 therein which communicates with compression chamber 26 via tubular portion 50. The effective volume of reexpansion chamber 52 is varied by a movable wall in the form of a piston 54 which sealingly engages the wall of cylinder 48 and moves up and down therein. Piston 54 has a cylindrical projection 56 on the lower end thereof which fits within and completely fills the bore in tubular portion 50 when the piston is in its lowermost position. In this position (not shown in FIG. 3 but easily visualized), the bottom of projection 56 is substantially flush with the bottom of valve assembly 18 so that there is no modulating reexpansion volume and the compressor is operating at maximum capacity. In FIG. 3 piston 54 is shown in an intermediate position in which the compressor will operate at an intermediate capacity. The minimum compressor capacity position of piston 54 is at the top of cylinder 48.

The apparatus as described to this point is similar in principle of operation to that disclosed in assignee's U.S. Pat. No. 4,685,489, the disclosure of which is incorporated herein by reference.

The unique aspect of the present invention resides in the manner in which piston 54 is activated to achieve the desired degree of modulation. This is accomplished utilizing lubricating oil under pressure from the existing oil pump and a unique configuration of valves. The arrangement provides an infinite number of degrees of modulation from maximum to minimum.

Figure 5:
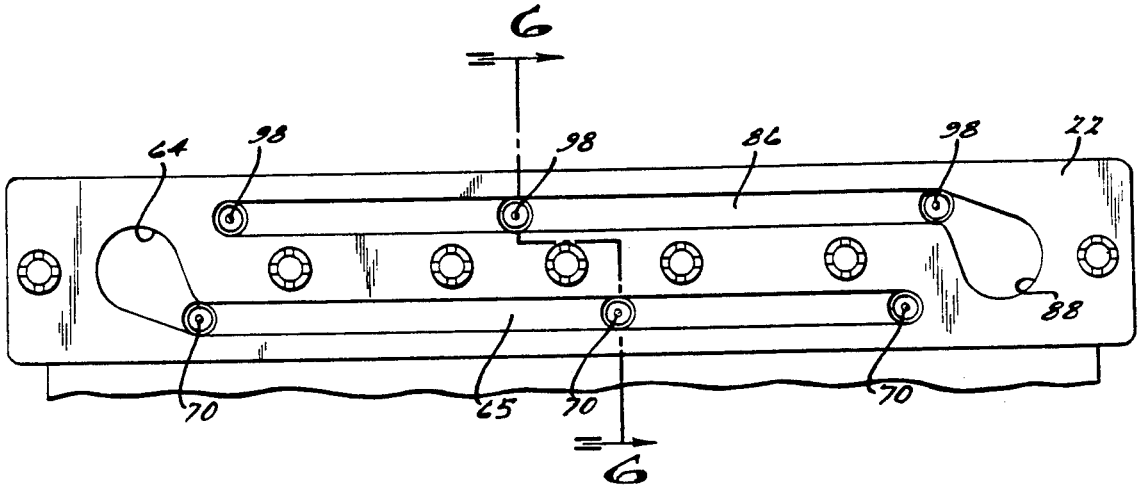
FIG. 5 is a vertical sectional view taken generally along line 5—5 in FIG. 3.
Figure 6:
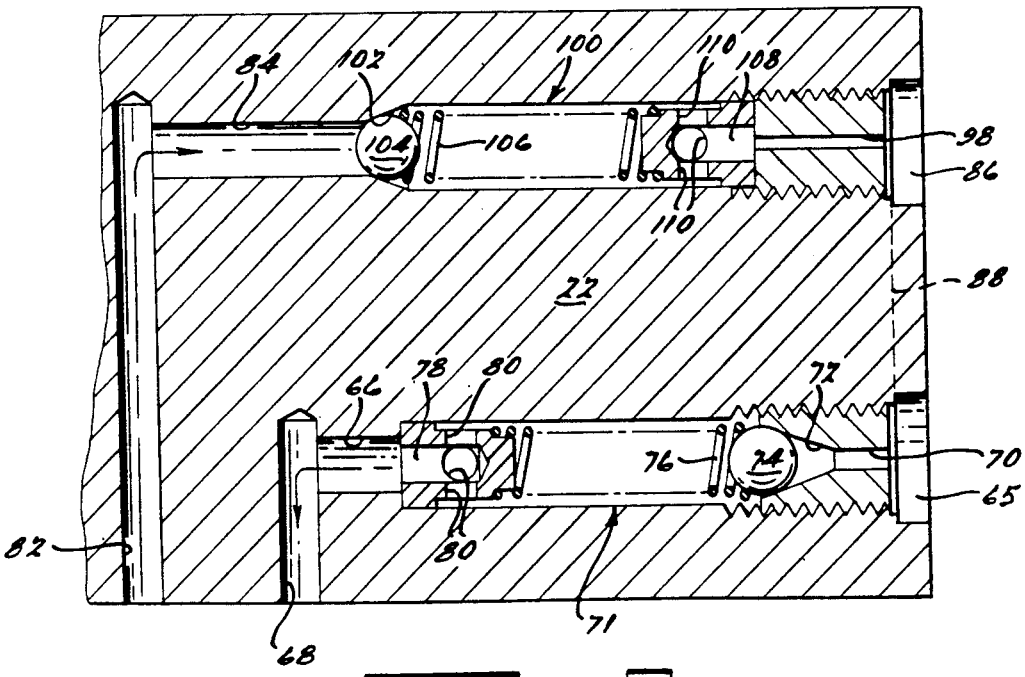
FIG. 6 is a partial vertical sectional view taken generally along line 6—6 in FIG. 5.

The compressor of this invention is provided with a conventional lubricating pump 58 mounted on the front thereof and driven by the motor which powers the compressor. Internally of body 10 is all the necessary plumbing (not shown) to accomplish lubrication of the moving parts of the compressor in the usual manner by supplying them with oil taken from the sump and pressurized by pump 58. For purposes of the present invention, pump 58 is provided with an additional discharge line 60 which communicates with an inlet solenoid valve 62 which functions when energized to an open position to supply lubricating oil under pressure to a port (not shown) in manifold 24 which communicates with a recess 64 in the face of modulation head 22 (FIG. 5) to which manifold 24 is affixed. Recess 64 is in fluid communication with an elongated recess 65 in the same surface which communicates with three pairs of passages 66 and 68 (FIG. 6) which carry fluid to reexpansion chamber 52 above piston 54, one pair of such passages being provided for each reexpansion chamber 52 and compression chamber 26. Each passageway 66 has therein a flow restricting orifice 70 and a standard ball-type check valve 71 comprising a conical seat 72, a ball valve 74, a spring 76 biasing ball 74 toward seat 72 and a discharge passageway 78 connected to radial passages 80, as best seen in FIG. 6. Check valves 71 permit oil flow only in a direction toward the reexpansion chambers and only when solenoid valve 62 is open.

Return oil from each of the reexpansion chambers above piston 54 passes through a pair of passages 82 and 84 to an elongated recess 86 on head 22 which communicates with a recess 88 which is in fluid communication with a suitable aligned port 90 (FIG. 3) which communicates with an outlet solenoid valve 92 connected to a return line 94 which communicates with the oil sump in the bottom of body 10 via a suitable fitting assembly 96, which can utilize a former sight glass port if desired. Each passage 84 has therein a flow restricting orifice 98 and a check valve 100 comprising a conical seat 102, a ball valve 104, a spring 106 biasing ball 104 toward seat 102, and a discharge passage 108 connected to a plurality of radial passages 110, as best seen in FIG. 6. Check valve 100 permits oil flow in a direction only away from its respective reexpansion chamber above piston 54 and only when solenoid valve 92 is open.

The dimensions of the inlet and outlet orifices for each modulating chamber are chosen to control the performance dynamics of the system, to obtain the desired result. For example, in a given refrigerating application it may be desirable to have a complete response of the modulating device within 30 seconds under the worst normally encountered operating conditions, i.e. 45 degrees F. evaporating and 130 degrees F. condensing. This point is chosen because it is a point at which pumping pressures are at or near a maximum and therefore movement of the modulating piston in an advancing direction is relatively slow. The orifice dimension to accomplish this may be readily determined through trial and error. Furthermore, in order to facilitate the controlling of temperatures, it may also be desired to have the modulating device unload with the same response time as it loads. With this requirement, the outlet orifice would be much smaller than the inlet orifice because generally speaking the compression chamber pressures are much greater than those exerted in the modulating chamber by the oil pump. Again, the exact dimension can be determined by trial and error. Furthermore, these performance characteristics in a given system can be easily changed by merely removing the manifold and substituting orifices of a different diameter.

Figure 7:
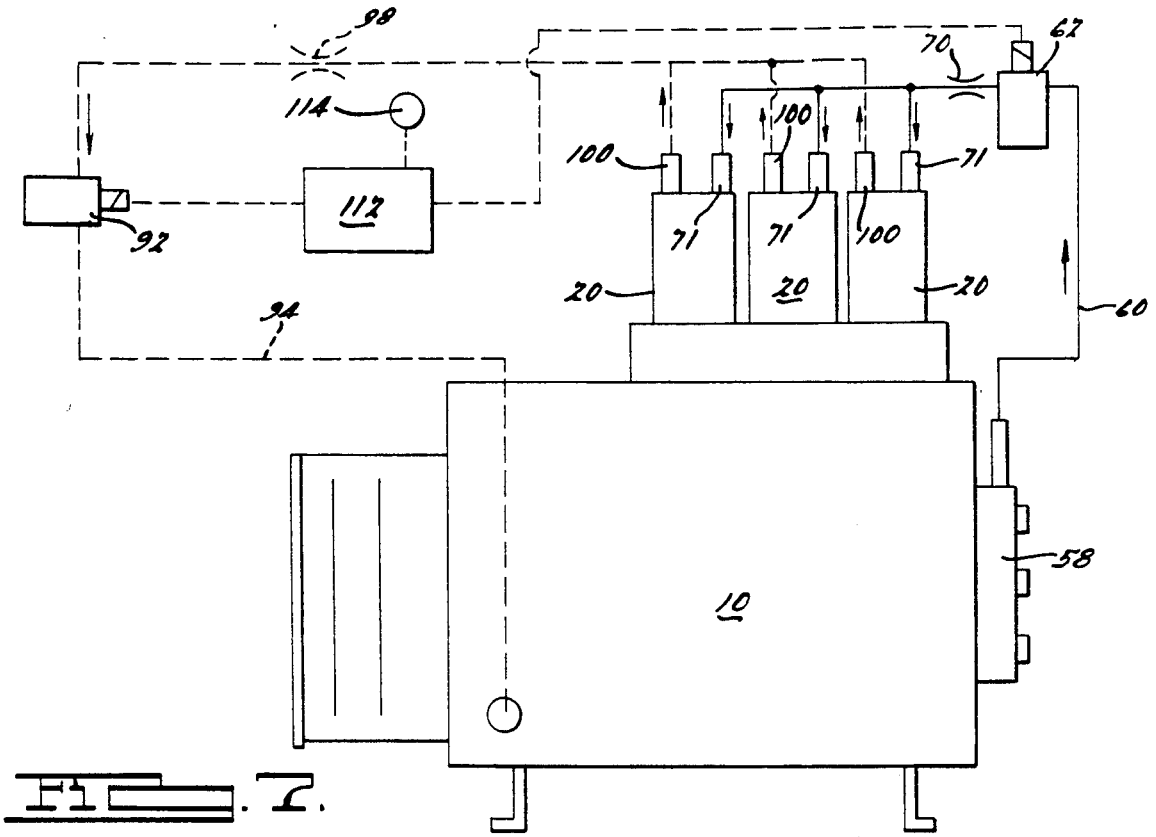
FIG. 7 is a schematic diagram showing the basic components of the modulation system of the present invention applied to a multi-cylinder compressor.

In FIG. 7 the entire modulating system for a three cylinder compressor is illustrated schematically. All of the parts have been previously described and are indicated by the same reference numerals, with the exception of powered control unit 112 which is electrically interconnected to solenoid valves 62 and 92 to control same in response to a sensed condition, sensed by sensor 114, which could be a simple thermostat. Control unit 112 can be mechanical or microprocessor controlled and is programmed to determine in the usual manner the degree of modulation needed at any given time, and then converting that information to appropriate on/off signals for solenoid valves 62 and 92. Modulating piston 54 can be fluid locked in any position by merely closing both valves 62 and 92. The two check valves for each cylinder, plus the parallel plumbing, isolates each of the modulating devices from one another and prevents the transfer of oil therebetween.

Figure 9:
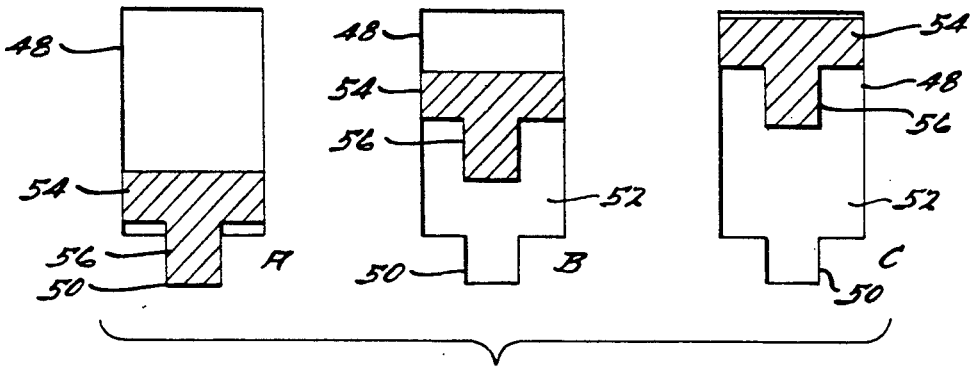
FIG. 9 illustrates several of the infinite number of positions the modulating piston may assume to provide different degrees of capacity modulation.
Figure 8:
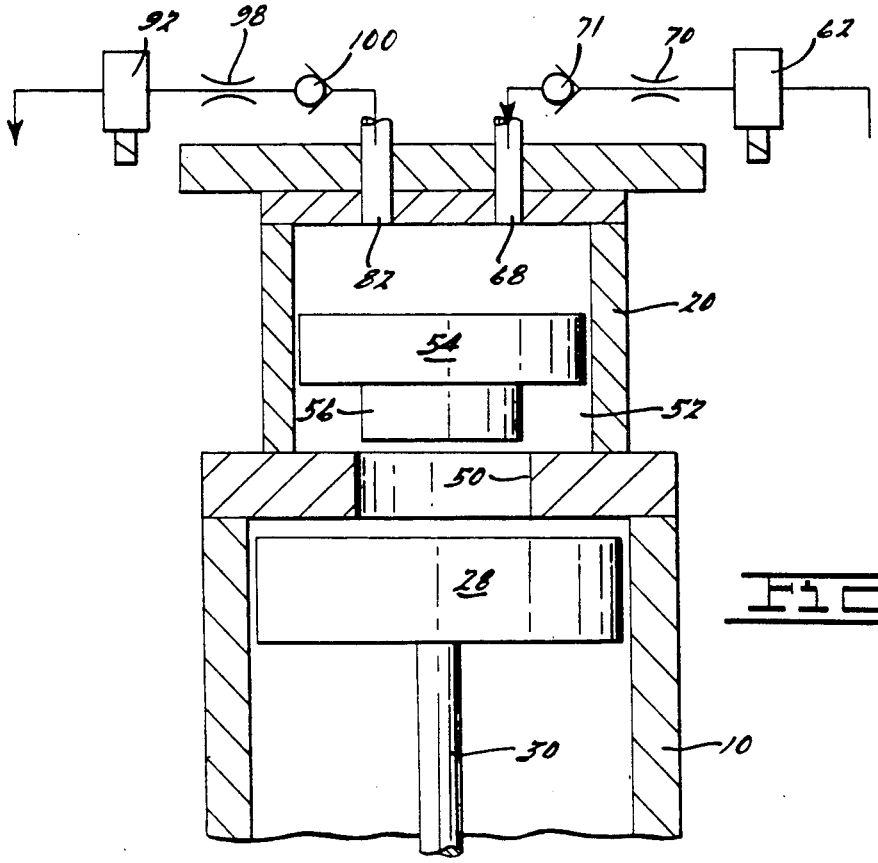
FIG. 8 is a diagrammatical view illustrating how the modulation system of the present invention operates.

FIG. 8 is a diagrammatical view showing how the system functions in a single compression chamber and reexpansion chamber, again using the same reference numerals as previously used, and FIG. 9 shows schematically modulating piston 54 in its zero capacity modulation position (i.e., maximum compressor capacity) at "A", an intermediate position at "B", and its maximum modulating position (i.e., minimum compressor capacity) at "C".

While it will be apparent that the preferred embodiments of the invention disclosed are well calculated to provide the advantages above stated, it will be appreciated that the invention is susceptible to modification, variation and change without departing from the proper scope or fair meaning of the subjoined claims.

What is claimed is:

1. A variable capacity compressor comprising:

a compression chamber;

a compressing member movable in said compression chamber for compressing fluid therein;

a drive mechanism for actuating said compressing member;

a reservoir providing source of liquid lubricant;

pump means for pumping said lubricant under pressure to said drive mechanism for lubricating same;

a reexpansion chamber in fluid communication with said compression chamber;

a movable wall in said reexpansion chamber, one side of said wall defining a reexpansion space in fluid communication with said compression chamber, the other side of said wall defining a modulating chamber;

first and second passages for placing said modulating chamber in fluid communication with said reservoir and said pump means, respectively;

a check valve in said first passage for preventing flow therethrough in a direction toward said modulating chamber;

a check valve in said second passage for preventing flow therethrough in a direction away from said modulating chamber;

a control valve in each of said passages for selectively permitting and preventing flow therethrough; and control means for actuating each of said control valves.

2. A compressor as claimed in claim 1 wherein said control means selectively actuates said valves in the following different configurations:

a first wherein said valve in said first passage is closed and said valve in said second passage is open to thereby introduce lubricating fluid under pressure to said modulating chamber to cause said wall to advance in a direction in which said reexpansion space is reduced and compressor capacity increased;

a second wherein both valves are closed and compressor capacity is maintained unchanged; and a third wherein said valve in said first passage is open and said valve in said second passage is closed to thereby permit lubricating fluid in said modulating chamber to return to said reservoir and permit said wall to retract under the influence of compression pressures in said compression chamber in a direction in which said reexpansion space is increased and compressor capacity decreased.

3. A compressor as claimed in claim 2 wherein said compression chamber has a minimum and maximum pressure therein during each pumping cycle, the output pressure of said pump means being between said minimum and maximum pressures whereby said moving wall is advanced only when the pressure in said compression chamber is less than said output pressure.

4. A compressor as claimed in claim 2 wherein said compression chamber has a minimum and maximum pressure therein during each pumping cycle, the output pressure of said pump means being between said minimum and maximum pressures whereby said moving wall is retracted only when the pressure in said compression chamber is greater than said output pressure.

5. A compressor as claimed in claim 1 wherein said control valves are solenoid valves.

6. A compressor as claimed in claim 1 further comprising a flow restrictor in each of said passages to reduce the rate of movement of said wall.

7. A compressor as claimed in claim 6 wherein each said flow restrictor includes an orifice, the orifice in the restrictor in said first passage being smaller than the orifice in the restrictor in said second passage.

8. A variable capacity compressor comprising:

a plurality of compression chambers;

a compressing member movable in each said compression chamber for compressing fluid therein;

a drive mechanism for actuating said compressing members;

a reservoir providing source of liquid lubricant;

pump means for pumping said lubricant under pressure to said drive mechanism for lubricating same;

a reexpansion chamber in fluid communication with each said compression chamber;

a movable wall in said reexpansion chamber, one side of said wall defining a reexpansion space in fluid communication with said compression chamber, the other side of said wall defining a modulating chamber;

first and second passages for placing each said modulating chamber in fluid communication with said reservoir and said pump means, respectively;

a check valve in each said first passage for preventing flow therethrough in a direction toward its modulating chamber;

a check valve in each said second passage for preventing flow therethrough in a direction away from its modulating chamber;

control valve means for selectively permitting and preventing flow through said passages; and control means for actuating said control valve means.

9. A compressor as claimed in claim 8 wherein said control valve means comprises a first control valve for controlling the flow from all of said first passages to said reservoir, and a second control valve for controlling the flow from said pump means to all of said second passages.

10. A compressor as claimed in claim 9 wherein said control means selectively actuates said valves in the following different configurations:

a first wherein said valve in each said first passage is closed and said valve in each said second passage is open to thereby introduce lubricating fluid under pressure to each said modulating chamber to cause each said wall to advance in a direction in which each said reexpansion space is reduced and compressor capacity increased;

a second wherein both valves are closed and compressor capacity is maintained unchanged; and a third wherein said valve in each said first passage is open and said valve in each said second passage is closed to thereby permit lubricating fluid in each said modulating chamber to return to said reservoir and permit each said wall to retract under the influence of compression pressures in each said compression chamber in a direction in which each said reexpansion space is increased and compressor capacity decreased.

11. A compressor as claimed in claim 9 wherein said first and second control valves are solenoid valves.

12. A compressor as claimed in claim 8 wherein each said compression chamber has a minimum and maximum pressure therein during each pumping cycle, the output pressure of said pump means being between said minimum and maximum pressures whereby said moving wall for each said compression chamber is advanced only when the pressure in said compression chamber is less than said output pressure.

13. A compressor as claimed in claim 8 wherein each said compression chamber has a minimum and maximum pressure therein during each pumping cycle, the output pressure of said pump means being between said minimum and maximum pressures whereby said moving wall for each said compression chamber is retracted only when the pressure in said compression chamber is greater than said output pressure.

14. A compressor as claimed in claim 8 further comprising a flow restrictor in each of said passages to reduce the rate of movement of said wall.

15. A compressor as claimed in claim 8 wherein said compression chambers are aligned in a row with said compressing members moving generally parallel to one another, and further comprising an elongated manifold disposed adjacent said compression chambers and having an outlet port, an inlet port, a first longitudinally extending cavity in fluid communication with said outlet port and a second longitudinally extending cavity in fluid communication with said inlet port, each of said first passages branching from said first cavity and each of said second passages branching from said second cavity, said control valve means including a first control valve for controlling flow through said outlet port and a second control valve for controlling flow through said inlet port.

16. A compressor as claimed in claim 15 wherein said check valves are disposed in said manifold.

17. A compressor as claimed in claim 15 further comprising a flow restrictor in each of said first and second passages in said manifold for controlling the rate of movement of the associated wall.

18. A compressor as claimed in claim 8 wherein all said first passages are connected in parallel with one another, and all said second passages are connected in parallel with one another.

* * * * *